United States Patent [19]

Cole

[11] Patent Number: 4,461,473

[45] Date of Patent: Jul. 24, 1984

[54] WEIGHTLIFTING APPARATUS

[75] Inventor: John W. Cole, 32343 Concord Dr., Madison Heights, Mich. 48071

[73] Assignees: John Cole; Steve Shuk, both of Sterling Heights, Mich.

[21] Appl. No.: 353,553

[22] Filed: Mar. 1, 1982

[51] Int. Cl.[3] ..... A63B 13/00

[52] U.S. Cl. ..... 272/123; 272/143

[58] Field of Search ..... 272/67, 68, 93, 116–143, 272/75

[56] References Cited

U.S. PATENT DOCUMENTS

| | | | |
|---|---|---|---|
| 1,333,005 | 3/1920 | Warner | 272/143 X |
| 2,819,081 | 1/1958 | Touraine | 272/67 |
| 3,384,370 | 5/1968 | Bailey et al. | 272/84 |
| 3,487,829 | 1/1970 | Barnett | 272/96 X |
| 3,534,960 | 10/1970 | Hanks | 273/75 |
| 3,640,527 | 2/1972 | Proctor | 272/134 X |
| 3,708,164 | 1/1973 | Griffin | 272/67 |
| 4,018,442 | 4/1977 | Galler | 272/123 |
| 4,288,073 | 9/1981 | Petrachonis et al. | 272/123 |
| 4,296,924 | 10/1981 | Anzaldua et al. | 272/117 |
| 4,355,633 | 10/1982 | Heilbrun | 272/116 X |

FOREIGN PATENT DOCUMENTS

| | | | |
|---|---|---|---|
| 452726 | 11/1927 | Fed. Rep. of Germany | 272/123 |

OTHER PUBLICATIONS

Nautilus Sportsmate, pp. 28–29, 6–14–79.

Universal "Thigh-Knee Machines", p. 28, 1974.

*Primary Examiner*—Richard J. Apley

*Assistant Examiner*—Chris Coppens

*Attorney, Agent, or Firm*—Krass & Young

[57] ABSTRACT

Weightlifting apparatus, especially for performing curling exercises, includes a rectangularly shaped frame having weights mounted on opposite extremities thereof. Gripping handles are secured to and disposed within a pair of spaced apart rings which are rotatably mounted within the frame. A cable trained around and interconnecting the rings synchronizes the rotation of the handles. A spring interconnecting the rings applies a biasing force resisting rotation of the handles.

29 Claims, 5 Drawing Figures

WEIGHTLIFTING APPARATUS

DESCRIPTION

1. Technical Field

The present invention generally relates to exercise apparatus, and deals more particularly with weightlifting devices, especially those employed for performing curling exercises.

2. Background Art

The development of the human bicep is an important part of the art of body building, particularly to the novice. The exercise normally practiced for building the biceps involves "curling". The curling exercise is performed by grasping a weighted bar with each hand and curling the forearm upwardly and back toward the upper arms.

Various types of weightlifting apparatus have been proposed in the past to increase the effectiveness of the curling exercise. One such device is disclosed in U.S. Pat. No. 3,384,370 to Bailey et al. The Bailey device consists of an essentially straight bar having conventional weights mounted on the opposite extremities thereof. A pair of spaced apart rings are secured to the bar, intermediate the extremities thereof. Handles are rotatably mounted within the rings to allow turning of the wrists during the curl. It is well known that twisting of the wrists during a curl provides increased exercise of the forearms as well as additional development of the biceps.

The Bailey device possesses a number of shortcomings, however, which have prevented its acceptance and use by body builders. One of the disadvantages of this device relates to the fact that the handles are rotatably mounted within the rings. This construction is rather unstable and presents the opportunity for fingers and items of clothing to become pinched between the rollers which mounts the handles on the rings. The rings themselves are quite heavy and rather bulky in order to provide sufficient strength to allow the weights to be mounted in cantilever fashion directly thereon. In fact, it has been found that this construction is rather weak because of the fact that the various sections of the bar must be secured to the rings by a series of welds which are constant shear loading.

Still another disdvantage of the Bailey device lies in the fact that the handles may be turned independently. This arrangement tends to promote uneven development of the muscles since the handles associated with the stronger arm may turn at a different rate or magnitude than the rings associated with the weaker arm.

It is therefore a primary object of the invention to provide weightlifting apparatus which overcomes each of the difficiencies discussed above.

A further object of the invention is to provide weightlifting apparatus of the type including a pair of rotatable handles in which programmed tension is applied to the handles which resists rotation thereof.

Another object of the invention is to provide weightlifting apparatus of the type described above having a novel frame construction for conveniently mounting the rotatable handles thereon.

These, and further objects of the invention, will be made clear, or will become apparent during the course of the description thereof hereinbelow.

DISCLOSURE OF THE INVENTION

According to the present invention, weightlifting apparatus is provided which includes an elongate, substantially rectangular frame having the opposite extremities thereof adapted to have weights mounted thereon. A pair of spaced apart rings are journalled for rotation within the frame. A pair of handles are disposed within and are respectively fixedly secured to the rings for rotation along with the latter. A pair of selectively shiftable collars are mounted on each handle to provide adjustment of the gripping width. In one embodiment, the frame is of U-shaped cross section defining channels within which portions of the rings are received. A cable trained around and interconnecting the rings synchronizes the rotation of the handles. A spring interconnecting the rings supplies a biasing force which tends to resist rotation of the handles.

BRIEF DESCRIPTION OF THE DRAWINGS

In the drawing, which forms an integral part of the specification and is to be read in conjunction therewith, and in which like reference numerals are employed to designate identical components in the various views.

BEST MODE FOR CARRYING OUT THE INVENTION

Figures 1, 2, 3, 4, 5:
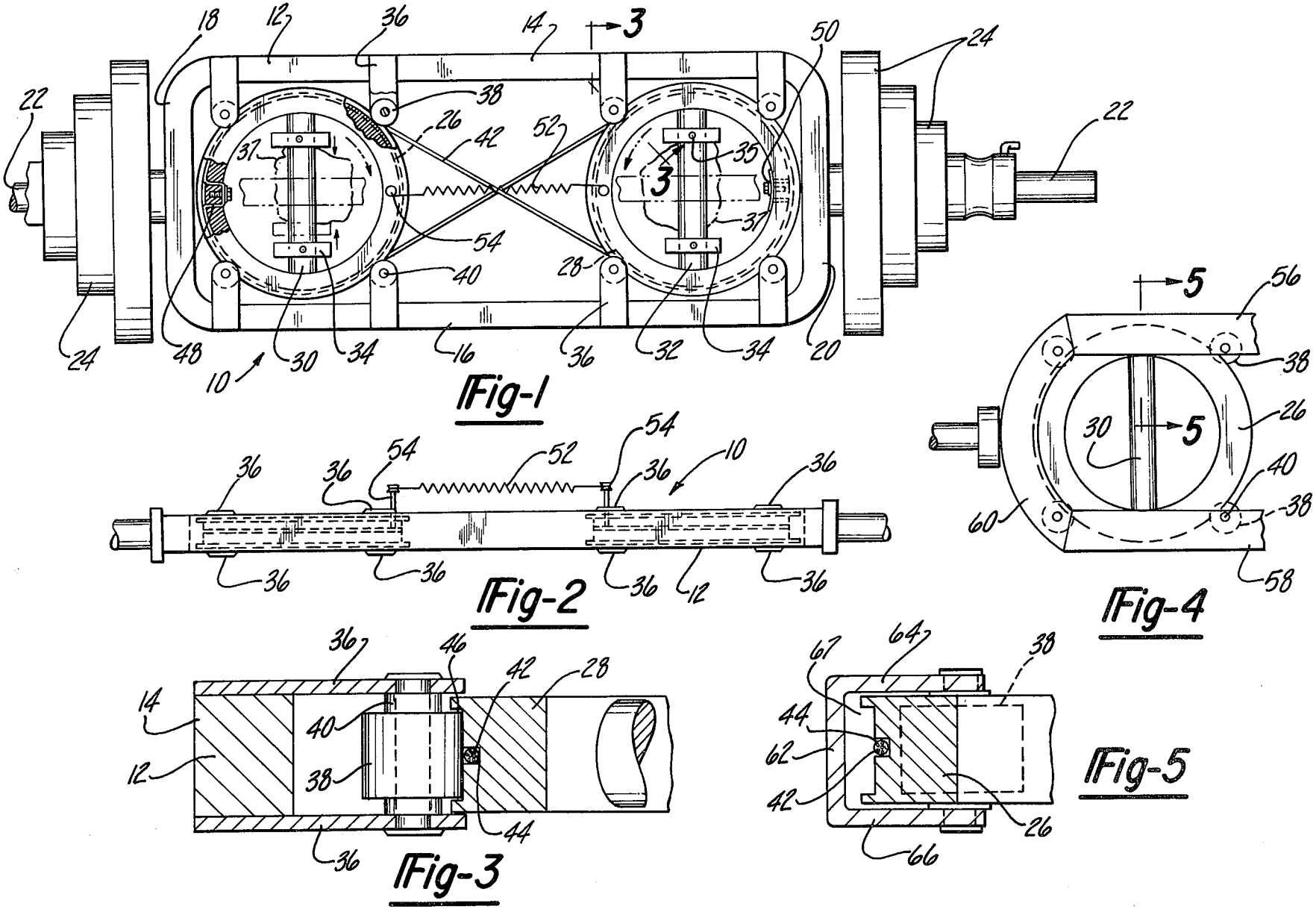
FIG. 1 is a fragmentary, longitudinal view of the weightlifting apparatus which forms the preferred embodiment of the present invention, parts being broken away in section for clarity.
FIG. 2 is a bottom plan view of the apparatus shown in FIG. 1.
FIG. 3 is a sectional view taken along the line 3—3 in FIG. 1.
FIG. 4 is a fragmentary, front view of one end of an alternate embodiment of the apparatus shown in FIG. 1; and, FIG. 5 is a sectional view taken along the line 5—5 in FIG. 4.

Referring first to FIGS. 1–3, the present invention is generally concerned with weightlifting apparatus, broadly indicated by the numeral 10, particularly adapted for performing curling exercises. The apparatus 10 includes a substantially rectangular, elongate frame 12 having a pair of rods 22 secured on opposite extremities thereof. Conventional weights 24 are mounted on rods 22; thus, weights 24 in combination with the force of gravity provide a means of resisting upward displacement of frame 12 by the user.

The rectangular frame 12 includes a pair of longitudinally extending members 14 and 16 whose opposite extremities are connected by means of transversely extending frame members 18 and 20 respectively. Frame 12 is depicted as being of essentially one-piece construction and having a rectangular cross-section, however it is recognized that such frame may be of multipiece construction and of the cross-sectional geometries.

A pair of spaced apart rings 26, 28 are rotatably mounted on the frame 12, intermediate the extremities thereof by means of roller bearings 38. Roller bearings 38 are rotatably mounted on axles 40 which are in turn supported by a pair of spaced apart arms 36 secured as by welding to frame 12.

Rings 26, 28 each include a rectangular depression 46 in the outer periphery thereof for captively holding the rollers 38 therein. Such peripheries also are provided with a groove 44 therein beneath the depression 46, the purpose of which will become later apparent.

Rings 26 and 28 have disposed therewithin and fixedly secured thereto cylindrically shaped gripping handles 30 and 32 respectively. Each of the ring/handle combinations 26, 30, 28, 32 may be of one piece construction, manufactured as by conventional casting techniques. Handles 30 and 32 each includes a pair of spaced apart collars 34 sleeved thereover and releasably secured thereto by means of set screws 35. Collars 34 define grip stops between which handles 30, 32 may be gripped by hands 37. The gripping width may be conveniently adjusted by simply releasing the set screws 35 and sliding the collars 34 to the desired position, after which set screws 35 are retightened.

Four of the rollers bearings 38 are associated with each ring 26, 28 so as to captively hold the rings 26, 28 for rotation about fixed axes. The rotation of rings 26, 28 are synchronized by virtue of a cable 42 constructed from steel or the like, disposed in a figure 8 pattern and trained through the grooves 44 of each ring 26, 28. One end of the cable 42 is secured to ring 26 by a clamp 48. Cable 2 is also secured intermediate its ends to ring 28 by a clamping assembly 50, thereby preventing rotation of ring 28 relative to cable 42.

A conventional helical spring 52 is connected between rings 30 and 32 by pins 54.

References now made to FIGS. 4 and 5 wherein an alternate form of the frame construction is depicted. Frame members 56, 58 and 60 are each of U-shaped cross section and comprise a base 62 and a pair of legs 64, 66 providing a channel 67. The outer periphery of rings 26, 28 are received within channel 67. The axles 40 carrying roller bearings 38 are mounted between legs 64 and 66 of each frame member. This frame construction is not only aesthetically pleasing and compact but also substantially reduces the material required to construct the frame.

In use, the hands 37 are placed on the handles 30, 32, between collars 34. As the apparatus 10 is curled, rings 30, 32 are rotated to the position shown in the phantom in FIG. 1. By virtue of cable 42, handles 30, 32 rotate in opposite directions at a synchronized rate. As handles 30, 32 are rotated, spring 52 applies programmed resistance to the rotation of handles 30, 32.

In view of the foregoing, it is apparent that the apparatus described above not only provides for the reliable accomplishment of the objects of the invention, but does so in a particularly effective and economical manner. It is recognized, of course, that those skilled in the art may make various modifications or additions to the preferred embodiment choosen to illustrate the invention, without departing from the spirit and scope of the present contribution of the art. Accordingly, it is to be understood that the protection sought and to be afforded hereby should be deemed to extend to the subject matter claimed and all equivalents thereof fairly within the scope of the invention.

I claim:

1. Weightlifting apparatus, comprising:

an elongate frame having the opposite extremities thereof adapted to have weights mounted thereon;

a pair of spaced apart rings;

means for rotatably mounting said rings on said frame and intermediate said opposite extremities of said frame;

a pair of handles deposed within and respectively fixedly secured to said rings for rotation with the latter; and means for synchronizing the rotation of said rings.

2. The apparatus of claim 1, wherein said frame includes a pair of longitudinally extending, spaced apart frame members and said rings are disposed between said frame members.

3. The apparatus of claim 2, wherein said mounting means includes a plurality of roller bearings mounted on said frame members.

4. The apparatus of claim 2, wherein said frame includes:

a pair of transversely extending frame members respectively secured to opposite extremities of said longitudinally extending frame members, and a pair of coaxial rods respectively secured to and extending longitudinally beyond said transversely extending frame members.

5. The apparatus of claim 2, wherein frame members are each of U-shaped cross section defining channels and at least portions of said rings are disposed within said channels.

6. The apparatus of claim 5, wherein said mounting means includes a plurality of roller bearings mounted essentially within said channels and engaging the outer periphery of said rings.

7. The apparatus of claim 1, wherein said synchronizing means includes a flexible elongate member trained around portions of the peripheries of said rings and secured to at least one of said rings.

8. The apparatus of claim 7, wherein each of said rings includes a circumferential groove in the outer periphery thereof and said flexible elongate member is disposed within said groove.

9. The apparatus of claim 1, including means for biasing each of said rings against rotation.

10. The apparatus of claim 9, wherein said biasing means includes a spring interconnecting said rings.

11. The apparatus of claim 1, including means for adjusting the width of the grip on said handle.

12. Weightlifting apparatus, comprising:

a frame including means adapted for mounting weights on said frame;

a pair of spaced apart handle means;

means for rotatably mounting said handle means on said frame; and means interconnecting said handle means for synchronizing the rotation of said handle means, said handle means each including a ring member and said synchronizing including an elongate flexible element trained around the peripheries of the ring members and secured to at least one of the ring members.

13. Exercise apparatus, comprising;

a pair of handles adapted to be respectively gripped by the hands of a user;

means for mounting said handles for rotational movement, said mounting means including a pair of spaced apart rings on said frame, and said handles being respectively disposed within said rings;

means for synchronizing the rotational movement of said handles relative to each other, said synchronizing means including a flexible line connected between said rings, said handles being secured to said rings, said mounting means including means for rotatably mounting said rings on said frame.

14. The exercise apparatus of claim 13, wherein said line is trained about the perimeter of each of said rings.

15. Exercise apparatus, comprising:

a frame having opposite lateral extremities and adapted to be displaced in unison by a user;

means for resisting the displacement of said frame;

a pair of space apart rings;

means for rotatably mounting said rings on said frame intermediate said opposite lateral extremities a pair of handles respectively secured to and disposed within said rings; and, means interconnecting said rings for synchronizing the rotation of said rings.

16. The apparatus of claim 15, wherein said frame includes a pair of longitudinally extending, spaced apart frame members and said rings are disposed between said frame members.

17. The apparatus of claim 16, wherein said mounting means includes a plurality of roller bearings mounted on said frame members.

18. The apparatus of claim 16, wherein said frame includes:

a pair of tranversely extending frame members respectively secured to opposite extremities of said longitudinally extending frame members, and a pair of coaxial rods respectively secured to and extending longitudinally beyond said transversely extending frame members.

19. The apparatus of claim 16, wherein said frame member are each of U-shaped cross section defining channels and at least portions of said rings are disposed within said channels.

20. The apparatus of claim 19, wherein said mounting means includes a plurality of roller bearings mounted essentially within said channels and engaging the outer periphery of said rings.

21. The apparatus of claim 15, wherein said synchronizing means includes a flexible elongate member trained around portions of the peripheries of said rings and secured to at least one of said rings.

22. The apparatus of claim 21, wherein each of said rings includes a circumferential groove in the outer periphery thereof and said flexible elongate member is disposed within said groove.

23. The apparatus of claim 15, including means for equally biasing each of said rings against rotation.

24. The apparatus of claim 23, wherein said biasing means includes a spring interconnecting said rings.

25. The apparatus of claim 15, including means for adjusting the width of the grip on said handle.

26. Weightlifting apparatus, comprising:

a frame;

means for resisting the displacement of said frame in at least one direction;

a pair of rotatable handles adapted to the gripped by a user for applying displacement force to said frame;

means for rotatably mounting said handles on said frame; and means for synchronizing the rotation of said handles in opposite directions of rotation.

27. The weightlifting apparatus of claim 26, wherein said mounting means includes a pair of rings and said synchronizing means includes a flexible line drivingly interconnected between said rings.

28. The weightlifting apparatus of claim 27, wherein said line includes first and second criscrossing sections disposed between said rings.

29. The weightlifting apparatus of claim 26, including means carried on said frame for equally biasing said handles against rotation.

* * * * *